US006015078A

United States Patent [19]

Almeras et al.

[11] Patent Number: 6,015,078

[45] Date of Patent: Jan. 18, 2000

[54] RETRACTABLE BARREL-HOLDING PLUG FIXING APPARATUS

[75] Inventors: Roland Almeras, Tournon; Patrick Herelier, Saint Jean de Muzols, both of France

[73] Assignee: Societe de Prospection et d'Inventions Techniques Spit, Cedex, France

[21] Appl. No.: 09/053,351

[22] Filed: Apr. 2, 1998

[30] Foreign Application Priority Data

Apr. 2, 1997 [FR] France ..... 97 03990

[51] Int. Cl.[7] ..... B25C 1/08; B25C 1/18

[52] U.S. Cl. ..... 227/10; 227/8; 227/9

[58] Field of Search ..... 227/10, 11, 9, 227/8

[56] References Cited

U.S. PATENT DOCUMENTS

| | | | |
|---|---|---|---|
| 3,652,003 | 3/1972 | Leonardo et al. | 227/10 |
| 3,786,977 | 1/1974 | Shamaly | 227/10 |
| 4,252,259 | 2/1981 | Brosius | 227/10 |
| 4,358,041 | 11/1982 | Ollivier | 27/10 |
| 4,487,353 | 12/1984 | Benson et al. | 227/9 |
| 4,577,793 | 3/1986 | Jochum | 227/10 |
| 4,651,912 | 3/1987 | Hawkins | 227/10 |
| 4,708,061 | 11/1987 | Buechel | 102/331 |
| 5,332,140 | 7/1994 | Almeras et al. | 227/9 |

FOREIGN PATENT DOCUMENTS

| | | |
|---|---|---|
| 0162009 | 4/1985 | European Pat. Off. . |
| 0236265 | 2/1987 | European Pat. Off. . |
| 0249037 | 5/1987 | European Pat. Off. . |
| 0308322 | 9/1988 | European Pat. Off. . |
| WO 9615880 | 5/1996 | WIPO . |

*Primary Examiner*—Peter Vo
*Assistant Examiner*—James P Calve
*Attorney, Agent, or Firm*—Lowe Hauptman Gopstein Gilman & Berner

[57] ABSTRACT

Apparatus comprising a barrel holder (2), a barrel (1) and an arm (4; 33) provided with a retractable holding finger (5) mounted on the barrel holder (2) to pivot about an axis (7) parallel to the axis (8) of the barrel holder by a ring (6) mounted to rotate on the barrel holder (2) about the axis (8) of the barrel holder (2), the arm (4; 33) provided with the retractable holding finger (5) allowing the barrel (1) to slide between a propellant charge loading position and a firing position.

6 Claims, 4 Drawing Sheets

RETRACTABLE BARREL-HOLDING PLUG FIXING APPARATUS

TECHNICAL FIELD

This invention relates to a plug fixing apparatus comprising a barrel in which a plug-driving piston can slide, a barrel holder and a grip handle integral with the barrel holder on which a trigger for driving the piston towards the front by means of a firing device is mounted.

BACKGROUND ART

The barrel can generally slide in its barrel holder between a rear firing position and a front loading position. Axial displacement of the barrel in its barrel holder is intended, inter alia, to return the piston to the rear firing position in the barrel for the next shot, the piston being situated at the front of the barrel after each shot, after having been driven there during firing.

The barrel is held in its barrel holder with the aid of a holding system which can be retracted in order to allow for disassembly of the apparatus.

The holding system has proven to be difficult to handle when disassembling the fixing apparatus.

SUMMARY OF THE INVENTION

The aim of the invention is to simplify and facilitate release of the barrel by proposing a retractable holding device.

To this end, the invention relates to a plug fixing apparatus comprising a barrel holder, a barrel and retractable means for holding the barrel in the barrel holder, allowing the barrel to slide between a propellant charge loading position and a firing position, characterised in that the retractable holding means comprise an arm provided with a holding finger mounted on the barrel holder to pivot about an axis parallel to the axis of the barrel holder by means of a ring mounted to rotate on the barrel holder about the axis of the barrel holder.

By virtue of the invention, the ring simply has to be rotated in order to release the barrel in axial translation in the barrel holder.

The holding arm advantageously has a cam surface intended to cooperate with the ring in such a manner that the rotation of the ring displaces the holding finger between a release position of the barrel and a holding position of the barrel, in which the finger projects into the interior of the barrel holder.

The ring is also advantageously open and the holding arm comprises a release head extending into the opening of ring.

In a preferred embodiment of the invention, the holding arm has a lug limiting the pivoting of the arm adapted to cooperate with a stop surface formed on the barrel holder.

The arm also preferably includes a supporting boss providing support in the holding position.

BRIEF DESCRIPTION OF THE DRAWINGS

The invention will be more readily understood from the following description of one particular embodiment of the fixing apparatus of the invention and of a variant with reference to the accompanying drawings, in which.

DETAILED DESCRIPTION OF THE INVENTION

Figure 6:
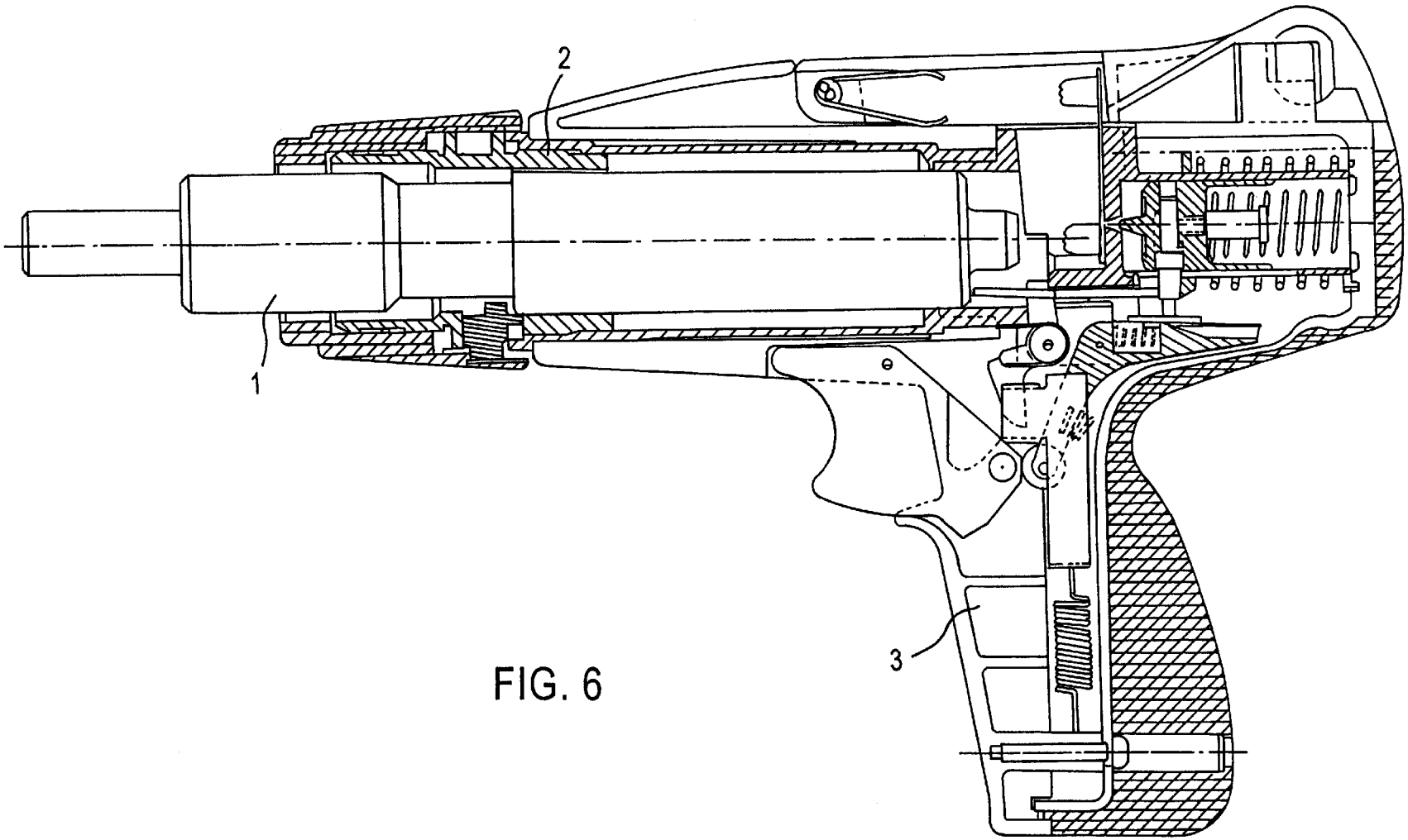
FIG. 6 is an axial section of the fixing apparatus of FIG. 1, according to the particular embodiment in the holding position of the barrel.
Figure 7:
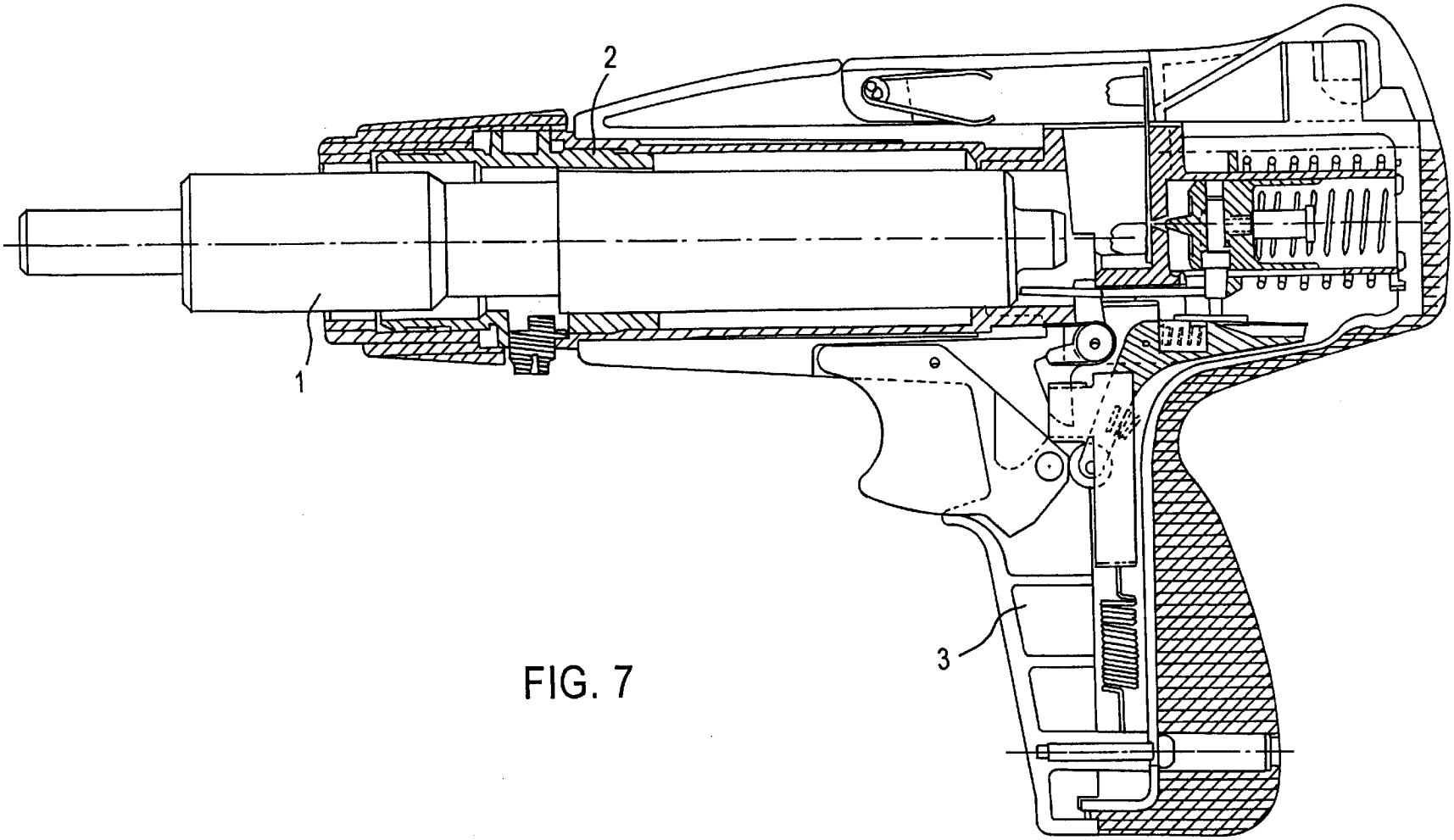
FIG. 7 is an axial section of the fixing apparatus of FIG. 6 in the release position of the barrel.

The plug fixing apparatus shown in FIGS. 6 and 7 comprises a barrel 1 in which a plug-driving piston (not shown) is slidably mounted and a barrel holder 2 in which the barrel 1 is slidably mounted, integral with a grip 3 provided with a trigger for firing, in this case by means of a firing device.

The fixing apparatus moreover comprises a retractable device for holding the barrel 1 in the barrel holder 2, allowing the barrel to slide between a front propellant charge loading position and a rear firing position in the holding position and allowing the barrel 1 to be disassembled from its barrel holder 2 in the release position.

Figure 1:
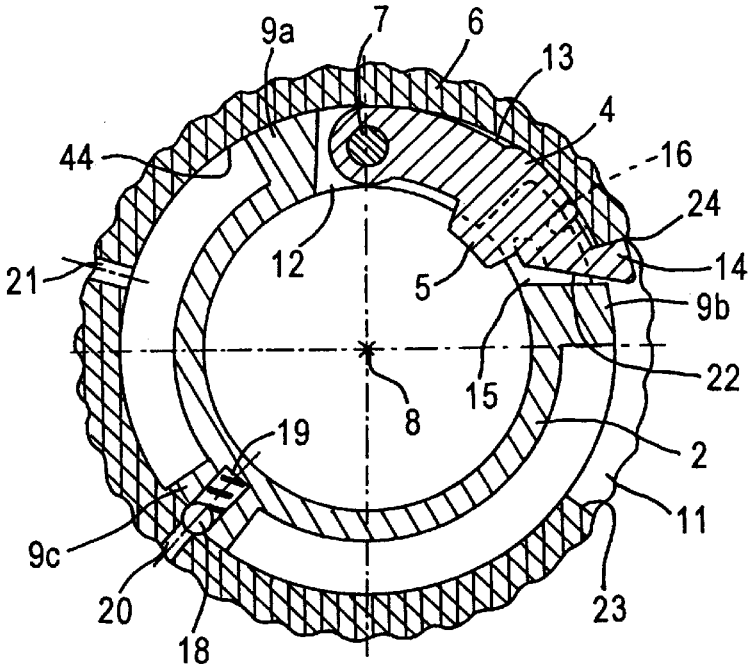
FIG. 1 is a cross section of a holding system of the particular embodiment of the apparatus in the holding position of a barrel in the apparatus.
Figure 2:
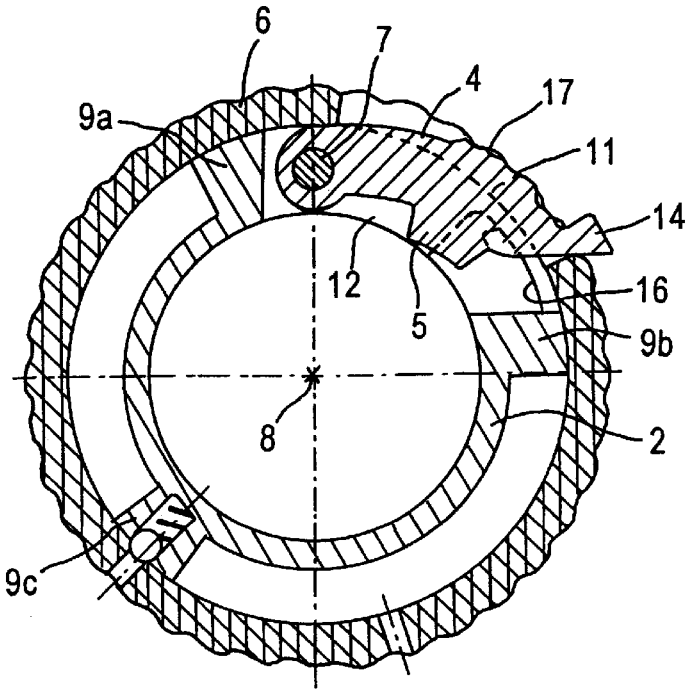
FIG. 2 is a cross section of the holding system of FIG. 1 in the release position of the barrel.

In the embodiment of FIGS. 1 and 2, the retractable system for holding the barrel 1 in the barrel holder 2 includes a retractable holding arm 4 and a ring 6 for actuating the arm 4.

The arm 4 is mounted on the barrel holder 2 and extends into a window 12 formed in the barrel holder 2. The arm 4 can pivot about an axis 7 fixed to the barrel holder 2 and parallel to the axis 8 of the barrel holder 2 between a holding position of the barrel 1 and a release position of the barrel 1, described hereinafter.

It will be noted that the arm 4 is curved slightly towards the axis 8 of the barrel holder 2, the curvature of the arm 4 being substantially the same as that of the barrel holder 2.

The ring 6 is mounted on the barrel holder 2 to rotate about the axis 8 of the barrel holder 2 and forms an opening 11 for receiving the arm 4.

Figure 3:
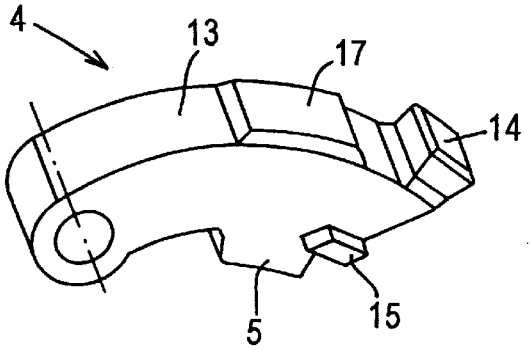
FIG. 3 is a perspective view of an arm of the holding system of FIG. 1.

The arm 4 shown in FIG. 3 comprises a holding finger 5 projecting from the inner surface of the arm 4 directed towards the interior of the barrel holder 2 and a release head 14 extending the free end of the arm 4 and extending into the opening 11 of the ring 6.

The outer surface 13 of the arm 4 serves as a cam surface intended to be pushed by a locking edge 24 of the opening 11 of the ring 6 in order to displace the holding finger 5 between its release position and its holding position in which it projects into the interior of the barrel holder 2.

The outer surface 13 of the arm 4 moreover has a boss 17 for support against the inner surface of the ring 6, intended to reinforce the support of the ring 6 against the arm 4 in the holding position.

The release head 14 is intended to serve as a stop for the ring 6 when the latter is in the locking position of the barrel 1 and to pivot the arm 4 from its holding position to its release position (FIG. 2) by means of the thrust of a release edge 23 of the opening 11 in the ring 6 opposite the locking edge 24 against a surface, in this case an inclined surface 22, of the release head 14 in order to pivot the arm 4 for release.

The arm 4 finally comprises a lug 15 projecting from a lateral surface of the arm 4 and the barrel holder 2 has a stop surface 16 intended to prevent excess pivoting of the arm 4 by means of the lug 15 after the barrel 1 is released.

The ring 6 in this case forms two indexing recesses 20, 21 and the barrel holder 2 is provided on its outer surface with a spring-mounted 19 ball 18 (formed in a radial protrusion 9*c*) intended to be housed in the two recesses 20, 21 in order to index the ring 6 to the locking position corresponding to the holding position of the arm 4 and to the release position respectively. The radial protrusion 9*c* is circumferentially spaced from two other radial protrusions 9*a* and 9*b* that engage the inner periphery of ring 6, as depicted in FIGS. 1 and 2.

Following the description of the construction of the fixing apparatus and its retractable holding system, the respective release and locking of the ring 6 in order to release the barrel 1 from its barrel holder 2 and to hold the barrel 1 in its barrel holder 2 will now be described.

In the locking position (FIGS. 1 and 6), the ring 6 covers the arm 4 in the holding position over the entire extent of the arm 4, except for the release head 14 which extends into the opening 11 of the ring 6. The head 14 therefore prevents rotation of the ring 6, the locking edge coming to bear against the head 14. In the locking position, the finger 5 projects into the passage of the barrel 1 inside the barrel holder 2. The indexing ball 18 is moreover housed in the locking recess 20.

In order to release the barrel 1, the ring 6 is rotated so that it uncovers the arm 4.

At the end of the rotation for release of the ring 6, the release edge 23 pushes the release head 14, thereby lifting the arm 4 which pivots across the opening 11 of the ring 6 until the lug 15 comes to bear against the stop surface 16 of the barrel holder 2. The arm 4 is then in the release position (FIGS. 2 and 7), the holding finger 5 being retracted from the passage of the barrel 1 inside the barrel holder 2.

In the release position of the ring 6 and the arm 4, the indexing ball 18 is housed in the release recess 21.

Figure 4:
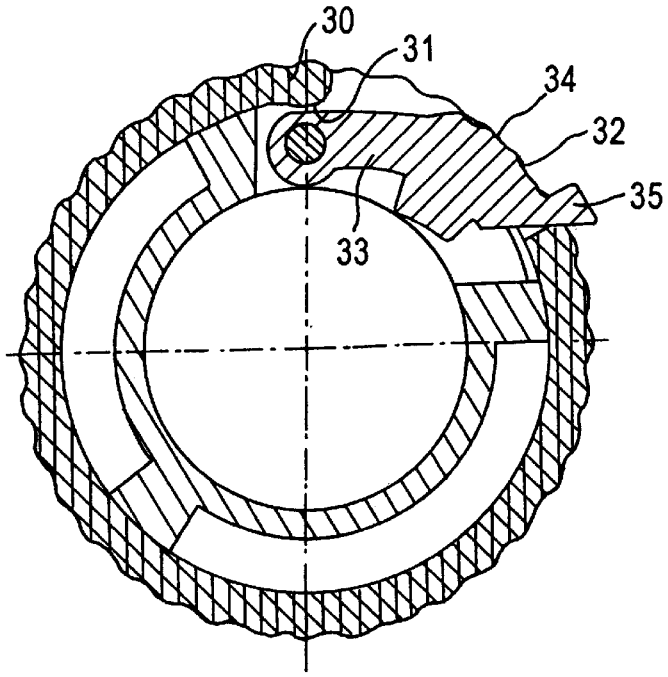
FIG. 4 is a cross section of the holding system of the variant embodiment in the release position of the barrel.
Figure 5:
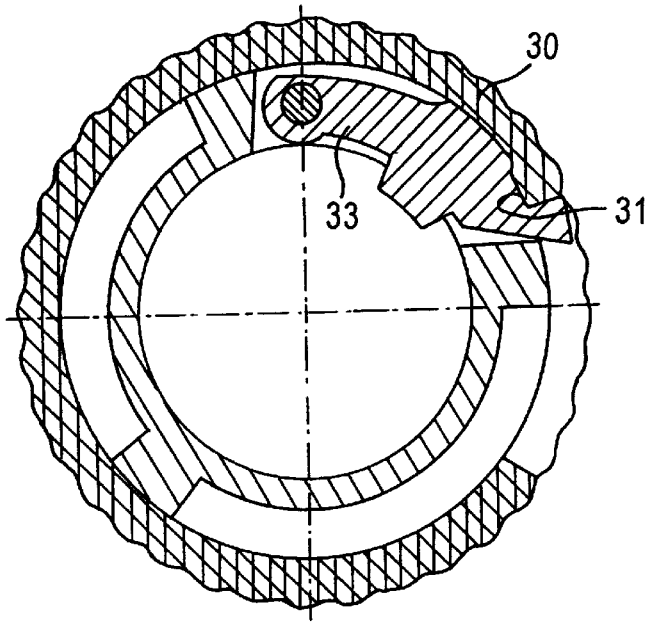
FIG. 5 is a cross section of the system of FIG. 4 in the holding position of the barrel.

In order to lock the barrel 1 in the holding position in the barrel holder 2, the ring 6 is rotated in the opposite direction to the locking direction. During rotation, the inner surface 44 and the locking edge 24 of the ring 6 bear against the cam surface 13, then the boss 17 of the arm 4 which pivots towards the axis 8 of the barrel holder 2 until the release head 14 comes to bear against an edge of the window 12 in the barrel holder. The arm 4 and the ring 6 are then once again in the holding position and in the locking position respectively In the variant shown in FIGS. 4 and 5, instead of the ball 18 and the recesses 20, 21, the indexing system comprises a boss 31 situated on the inner surface of the flexibly mounted ring 30 and intended to be housed in a hollow 32 formed between the supporting boss 34 and the release head 35 of the holding arm 33 in order to index the ring 30 to the holding position.

We claim:

1. Plug fixing apparatus comprising a barrel holder, and barrel and retractable holding means for selectively holding the barrel in the barrel holder and allowing the barrel to slide between a propellant charge loading position and a firing position wherein said retractable holding means includes a holding a having a holding finger mounted on the barrel holder to pivot about an axis parallel to an axis of the barrel holder, and a ring mounted to rotate on the barrel holder about the axis of the barrel holder to thereby pivot said holding finger into and out of locking engagement with said barrel, said ring being engageable with said holding arm in each opposite rotational direction of the ring to positively contact said holding arm to induce said pivoting movement of said holding finger during ring rotation;

wherein the holding arm has a cam surface engageable with the ring in such a manner that the rotation of the ring displaces the holding finger between a release position of the barrel and a holding position of the barrel, in which the holding finger projects into an interior of the barrel holder;

said rind includes an opening and the holding arm comprises a release head (14; 35) extending into the opening;

wherein the release head has an inclined face and said ring opening has circumferentially spaced release and locking edges wherein the release edge is adapted to be rotated into contact with the inclined face to pivot the holding arm into the release position.

2. Fixing apparatus according to claim 1, in which the holding arm, includes a supporting boss (17; 34) providing support in the holding position.

3. Fixing apparatus according to claim 1, in which a ball (18) spring-mounted (19) on the barrel holder (2) is intended to cooperate with two recesses (20, 21) formed in the ring (6) in order to index the ring (6) to the holding position of the barrel (1) or to the release position of the barrel (1) respectively.

4. Fixing apparatus according to claim 1, in which the ring (30) is flexibly mounted and has a boss (34) intended to be housed in a hollow (32) in the holding arm (33) in order to index the ring (30) to the holding position of the barrel (1).

5. Plus fixing apparatus comprising a barrel holder, a barrel and retractable holding means for selectively holding the barrel in the barrel holder and allowing the barrel to slide between a propellant charge loading position and a firing position wherein said retractable holding means includes a holding arm having a holding finger mounted on the barrel holder to pivot about an axis parallel to an axis of the barrel holder, and a ring mounted to rotate on the barrel holder about the axis of the barrel holder to thereby pivot said holding finger into and out of locking engagement with said barrel, said ring being engageable with said holding arm in each opposite rotational direction of the ring to positively contact said holding arm to induce said pivoting movement of said holding finger during ring rotation;

wherein said holding arm has a lug projecting from a lateral surface of the holding arm for limiting the pivoting of the holding arm through contact with a stop surface formed on the barrel holder.

6. A plug fixing apparatus comprising a barrel holder, a barrel and a retractable holding arrangement mounted to selectively hold the barrel in the barrel holder and allow the barrel to slide between a propellant charge loading position and a firing position, wherein said retractable holding arrangement includes a holding arm having a holding finger mounted on the barrel holder to pivot about an axis, and a ring mounted to rotate on the barrel holder about the barrel holder axis to thereby pivot said holding finger into and out of locking engagement with said barrel as a result of positive contact between said ring and said holding arm, wherein the holding arm has a cam surface engageable with the ring in such a manner that the rotation of the ring displaces the holding finger between a release position of the barrel and a holding position of the barrel, in which the holding finger projects into an interior of the barrel holder;

said ring includes an opening and the holding arm comprises a release head extending into the opening;

wherein the release head has an inclined face and said ring opening has circumferentially spaced release and locking edges wherein the release edge is adapted to be rotated into contact with the inclined force to pivot the holding arm into the release position.

* * * * *